United States Patent [19]

Moreni

[11] 4,122,690

[45] Oct. 31, 1978

[54] METHOD AND MEANS FOR TRANSFERRING KNIT LOOPS BETWEEN CYLINDERS OF A DOUBLE CYLINDER KNITTING MACHINE

[75] Inventor: Battista Moreni, Brescia, Italy

[73] Assignee: Speizman Industries, Inc., Charlotte, N.C.

[21] Appl. No.: 818,417

[22] Filed: Jul. 25, 1977

Related U.S. Application Data

[63] Continuation of Ser. No. 815,403, Jul. 13, 1977, abandoned.

[30] Foreign Application Priority Data

Jul. 30, 1976 [IT] Italy ..... 25909 A/76

[51] Int. Cl.[2] ..... D04B 9/10

[52] U.S. Cl. ..... 66/14; 66/13; 66/58; 66/115

[58] Field of Search ..... 66/14, 121, 199, 13, 66/58, 148, 50 R (U.S. only), 115, 50 A

[56] References Cited

U.S. PATENT DOCUMENTS

| | | | |
|---|---|---|---|
| 555,161 | 2/1896 | Harbaugh | 66/58 |
| 1,127,337 | 2/1915 | Williams | 66/58 |
| 1,285,526 | 11/1918 | Williams | 66/58 |
| 3,323,329 | 6/1967 | Spencer | 66/14 |

FOREIGN PATENT DOCUMENTS

| | | | |
|---|---|---|---|
| 560,614 | 9/1932 | Fed. Rep. of Germany | 66/121 |
| 10,599 of | 1901 | United Kingdom | 66/14 |
| 543,551 | 3/1942 | United Kingdom | 66/14 |
| 1,212,573 | 11/1970 | United Kingdom | 66/14 |

*Primary Examiner*—Werner H. Schroeder
*Assistant Examiner*—Andrew M. Falik
*Attorney, Agent, or Firm*—Richards, Shefte & Pinckney

[57] ABSTRACT

Method and means for transferring knit loops from single-hook needles on one cylinder to single-hook needles on the other cylinder of a double cylinder circular knitting machine. In the method and needles are displaced at an inclination outwardly of their cylinders to allow axial sliding of the opposing needles behind the inclined needles and into the loops held on the inclined needles; the inclined needles are then withdrawn to shed the hooks, which are then received on the hooks of the other needles. The means includes radial pins slidably carried in the cylinders for engagement and operation by stationary radial cams located within the cylinders, the pins extending through the cylinders and into engagement with the stems of the needles for radially displacing the needles outwardly to the inclined positions required by the described method.

10 Claims, 4 Drawing Figures

METHOD AND MEANS FOR TRANSFERRING KNIT LOOPS BETWEEN CYLINDERS OF A DOUBLE CYLINDER KNITTING MACHINE

CROSS-REFERENCE TO RELATED APPLICATION

This application is a continuation of U.S. patent application Ser. No. 815,403, filed July 13, 1977, now abandoned.

BACKGROUND OF THE INVENTION

The present invention relates to double cylinder knitting machines and their operation, and more particularly to method and means for transferring knitting from needles of one cylinder to needles of the other cylinder of a double cylinder knitting machine.

As is well known, the plain, regular or knit stitches are formed in double cylinder knitting machines on the needles of the lower cylinder, whereas purl stitches are formed on the needles of the upper cylinder. It is also known that in the construction of rib knitting and in any cases where plain and purl stitches are combined in knitting, the knitting is done on the upper and lower cylinders selectively and alternatively; therefore, in order to change from plain stitches to purl stitches and vice versa, it is necessary to transfer the stitches held by the needles from one cylinder to the other cylinder.

Heretofore, transferring of stitches on a double cylinder knitting machine has conventionally been accomplished with double-hook needles that are themselves transferred from one cylinder to the other while retaining a stitch or knit loop thereon. The advantage of this prior transferring is that it causes little problem in the actual transfer of the stitches themselves from one hook to the other, as both hooks are on the same needle. However, because the needles must be transferred from one cylinder to the other, complicated mechanical systems are necessary with attendant breaking and bending problems, and due to the amplitude of the required axial motions of the double-hook needles, the speed of operation must be significantly limited.

Another prior art arrangement effects transfer using specially formed single-hook needles so that opposing needles can be slid side-by-side with hooks overlapping to transfer stitches from the needle of one cylinder into the hook of the adjacent needle of the other cylinder. This arrangement, however, requires special needles with heads, or hooks, slightly offset from the shank, or thinned to half the thickness. The precision is such that even the vibrations may cause opposing needles to strike each other with resulting damage, and the requirement of fine tolerances obviously affects the manufacturing cost of the machine, which must also be rather rigid and heavy to minimize such vibrations.

In contrast, the present invention provides both a method and means for the transfer of knit loops or stitches between cylinders in double cylinder knitting machines, which method and apparatus will be inherently exempt from the problems mentioned; because common single hook needles are used within ordinary amplitudes of axial motion thereof and within ordinary limits of precision for needles, motions, and machines.

SUMMARY OF THE INVENTION

Briefly described, the improvement of the present invention is in a double cylinder machine operable for selectively knitting plain and purl stitches wherein single-hook knitting needles are disposed in both cylinders for axial reciprocation in a knitting operation, the upper cylinder needles being aligned with the lower cylinder needles to form pairs, and means act on the needles for displacing needles radially outwardly from their cylinders to allow positioning of the hooks of the displaced needles for entry into knit loops initially carried on the displaced needles and for receipt of the loops on the other needles upon shedding of the loops from the displaced needles to effect transfer of the loops.

Preferably, the displacing means includes elements carried by the cylinders for displacing engagement with the needles and acts to incline them to position their hooks radially outwardly from their cylinders, bending them, and includes cams engagable with the displacing elements to operate them for needle displacement.

In the preferred embodiment of the present invention the displacing elements are in the form of pins extending radially through the walls of the cylinders and the cams are formed by stationary rings positioned and mounted interiorly of the cylinder walls in aligned engagement with the inner ends of the pins.

In the method of the present invention knit loops formed on single hook needles carried on one cylinder of a double cylinder circular knitting machine are transferred between cylinders and opposing single hook needles. The loops are transferred by displacing a needle having a loop thereon radially outwardly from its respective cylinder, relatively sliding opposing needles to position the hook of the opposing needle carried by the other of the cylinders radially inwardly of the hook of the displaced needle for entry of the hook of the needle carried by the other cylinder into the loop carried by the displaced needle, and shedding the knit loop from the displaced needle onto the opposing needle.

DESCRIPTION OF THE PREFERRED EMBODIMENT

Figure 1:
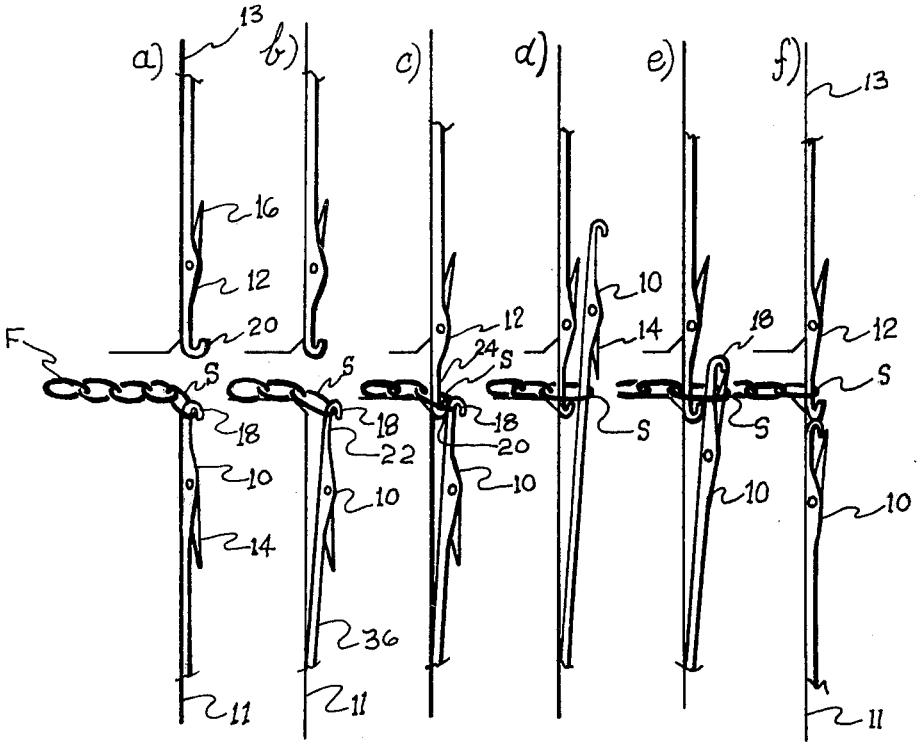
FIG. 1 is a schematic series of illustrations of the sequence of motions of a pair of opposed knitting needles according to the preferred embodiment of the present invention.

FIGS. 1*a* to *f* shows schematically the characteristic stages of the method of the preferred embodiment of the present invention for transferring a knit loop or stitch from a singlehook knitting needle 10 disposed in, or carried by, a lower cylinder 11, for instance, to a single-hook knitting needle 12 disposed in an upper cylinder 13 of a double cylinder circular knitting machine operable for selectively knitting plain and purl stitches. In FIG. 1*a* the two needles 10 and 12, forming a typical aligned opposing pair of needles, one from each cylinder, are in a wait or rest position, with their respective latches 14 and 16 open. The lower needle 10 holds with its hook 18 the last loop or stitch S formed thereon of a knit fabric F (represented here by a series of loops) which falls inside the cylinder, while the hook 20 of the upper needle 12 is empty. At FIG. 1*b*, which is the first actual stage of the transfer method according to the invention, the lower needle 10 is displaced to incline it as shown, with its hook 18 displaced normal to the needle stem's axis and positioned toward the outside of the cylinder 11 in a radial direction. In this slightly inclined position the needle stretches and opens the knit loop or stitch S initially carried or engaged by the neck 22 of the hook 18. At FIG. 1*c* the needle 12 is lowered by relative sliding until its hook 20 is inserted radially inwardly of the hook 18 into the now-opened loop carried on the needle 10, while the displaced needle 10 remains in its inclined position.

At this point the displaced needle 10 must free itself from the stitch S which is now looped also around the neck 24 of the hook 20 of the opposing upper needle 12, which is positioned to receive the loop S when shed by the needle 10. To carry this out as shown in FIG. 1*d*, the needle 10 is moved up, still slightly inclined, until its latch 14 clears the opened loop S. Thereby, at the next stage as shown by FIG. 1*e*, the needle 10 may move downwardly to slip out of, or shed, the stitch S since the stitch S itself makes the latch 14 close over the hook 18. At FIG. 1*f*, the slipping out accomplished and the needle 10 having moved below the needle 12, the needle 10 is returned to its normal, not-inclined position. The needle 10 then rests idle, whereas the needle 12 has now received the stitch S upon its shedding by the needle 10 and now holds the stitch S just shed and transferred and is ready to form a purl stitch in the usual manner as well-known in the art.

Obviously a similar sequence takes place for the transfer of a stitch from an upper needle to a lower needle. In the description of the method the respective actions of the needles were pointed out, without specifying the means or the mechanisms by which these actions were obtained. As for the longitudinal, or axial, motions of the needles, suffice it to say that they are quite normal and that any of the apparatus used for the formation of loops or stitches on the needles of the cylinders of the machines commonly known can be used here, and such apparatus is not described here as it is no part of the invention. Means acting on the needles for displacing them radially outwardly from the cylinders for causing the inclining motions of the needles are explained hereinafter in the discussions relative to FIGS. 2 and 3. The needles themselves are of a common type, and the needles of a single cylinder circular knitting machine can well be used.

Figure 2:
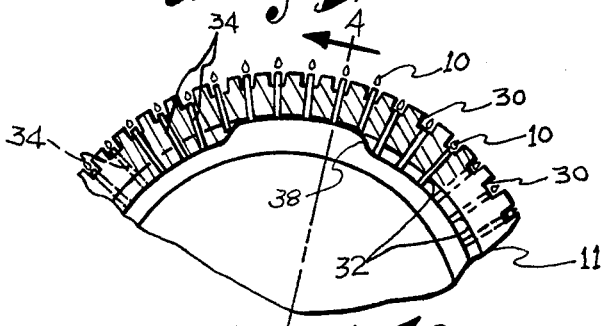
FIG. 2 is a partial horizontal cross-section of the lower cylinder and associated elements of the preferred embodiment of the present invention, taken along line 2—2 in FIG. 4.
Figure 3:
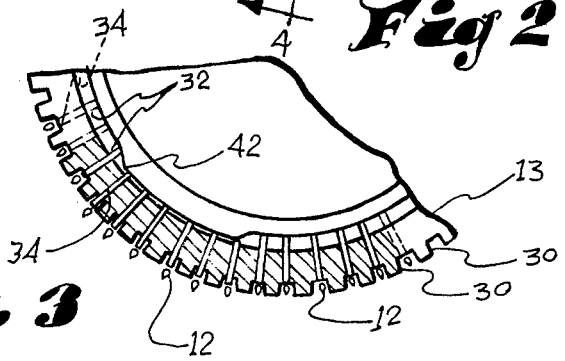
FIG. 3 is a partial horizontal cross-section of the upper cylinder similar to FIG. 2.
Figure 4:
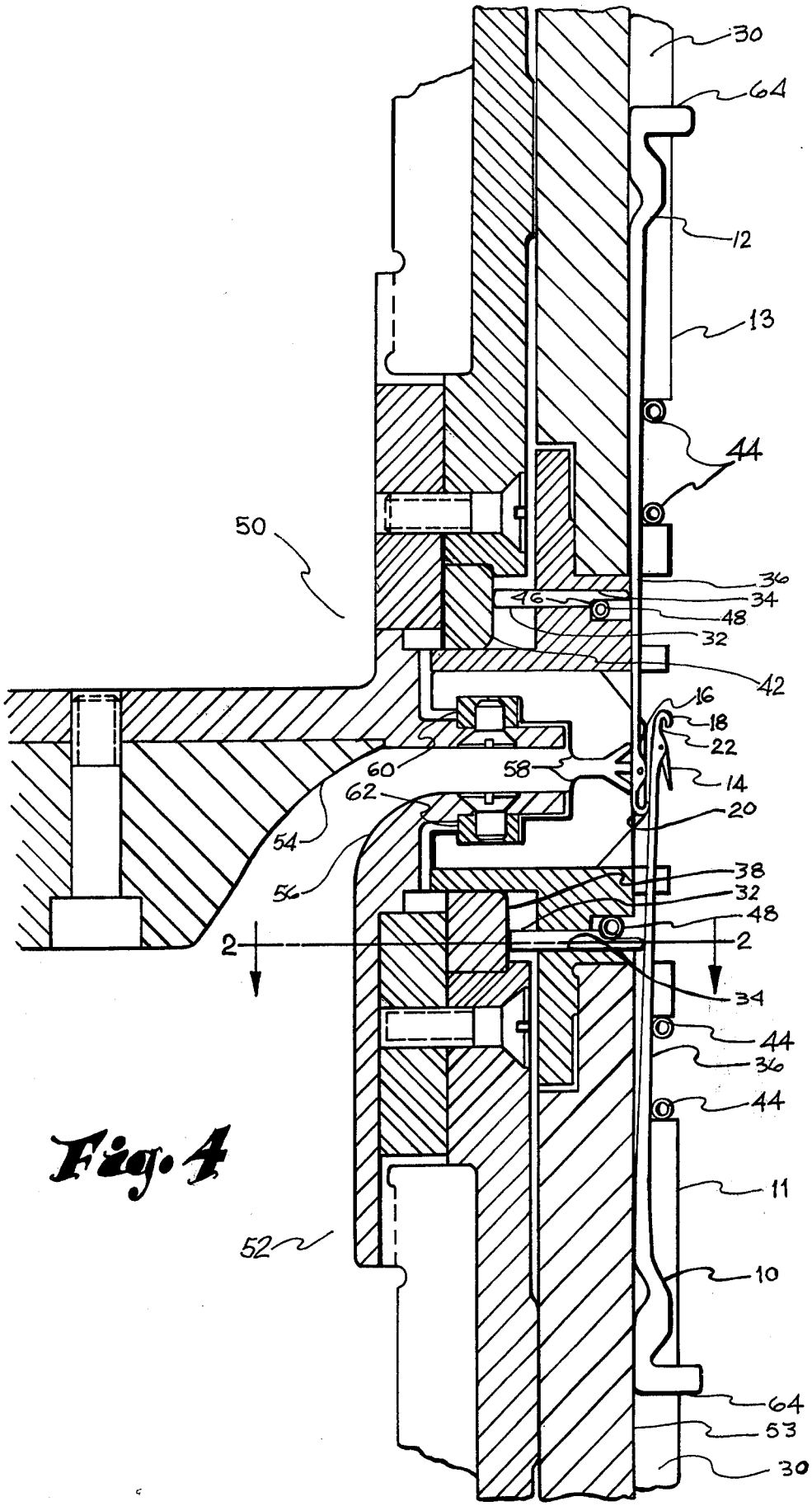
FIG. 4 is a partial vertical cross-section of the cylinders, needles and associated elements of the preferred embodiment of the present invention taken along line 4—4 in FIG. 2.

The preferred embodiment of the apparatus for obtaining the desired inclined displacement of the needles 10 and 12, to the desired extent and at the appropriate timing is shown in FIGS. 2, 3 and 4. FIG. 2 shows a circular knitting machine's lower cylinder 11 in schematic section, and shows slots 30 wherein the needles 10 are located, movably retained therein by the usual garter springs 44 (as shown in FIG. 4). Elements formed by small pins 32 slide in radial holes 34 extending through the walls of the cylinder 11, one hole 34 and one pin 32 extending therethrough corresponding to each needle 10. One end of each pin 32, as carried by the cylinder 11 in the respective hole 34, bears against the stem 36 (as best seen in FIG. 4) of the needle 10 for displacing engagement therewith and the other end protrudes toward the inside, beyond the internal wall of the cylinder 11. An angularly fixed cam contour 38 comprising a stationary ring cam is positioned interiorly of the internal wall of the cylinder 11 in engaging alignment with, and engages against the internally protruding ends of, the pins 32, and during a revolution of the cylinder 11, puts cyclicly in operation all of the pins 32, displacing and inclining the needles 10 in the manner and through the stages shown in FIG. 1. FIG. 3 is similar to FIG. 2, with the exception that it shows an upper cylinder 13 and the respective cam contour 42 generally oriented out of rotational phase with the cam contour 38 for the lower cylinder 11.

The details of the pins 32 engaged as radial pushers against a lower needle 10 or an upper needle 12 and bearing against the cam contours 38 and 42 respectively are shown in FIG. 4, which is a partial vertical cross-section taken in correspondence with the heads of two opposed needles. The pins 32 have shoulders 46 provided for engagement by retaining garter springs 48. In this preferred embodiment, the radially outwardly displacing push is applied to the needle stems 36 generally midway between the needle hooks 18 and 20 and the garter springs 44. By applying the push closer to the garter springs 44, it is possible to reduce the motion of the pins 32, but a greater precision is required because the motion is amplified at the needle hooks. The stem 36 of needle 10 as shown in FIG. 4 is bent slightly by the means displacing it, as well as displaced slightly out of the base 53 of the slot 30 toward its inclined position, as will be understood by considering the needle 10 to be fulcrumed at its butt 64 in the slot base 53 to overcome the load applied by the garter springs 44 with the inclining force applied by the pin 32. The bending occurs between the butt 64 and the pin 32 with the needles 10 and 12 and garter springs 44 acting to return the pins 32.

The stationary upper and lower guide and support members, (indicated generally by the reference numerals 50 and 52 in FIG. 4), are common parts of double cylinder circular knitting machines, and serve to guide and support the upper and lower cylinders 13 and 11, which surround the members 50 and 52. Upper and lower guide surfaces 54 and 56 are provided on the members 50 and 52 for guidance of knitted fabric away from the needles, and conventional sinkers 58 are provided for their usual purposes of controlling the stitches during knitting and transferring and are suitably moved and positioned in a radial direction within slots in the respective cylinders 13 and 11 by the upper and lower sinker cam tracks 60 and 62 which are fastened to the members 50 and 52. The butts 64 of the needles 12 and 10 extend beyond the surfaces of the respective cylinders 13 and 11 for engagement by conventional cams and other devices (not shown) which control in combination with conventional slides and jacks the axial reciprocation or longitudinal movements of the needles for and knitting transferring.

During each revolution of the cylinders 11 and 13, all of the needles 10 and 12 are displaced to their inclined positions, whether or not they are also axially manipulated to effect transfer, transferring occurring only from those needles that are axially as well as radially manipulated.

The method and means of the present invention depart from the traditional transferring methods and means mentioned in the Background of the Invention, and offer a new direction to the knitting techniques and the design parameters of double-cylinder knitting machines. This new concept involves direct and free insertion of the receiving needle hook into the stitch or loop to be transferred, while the loop is held positively stretched and open by the other needle. The latter needle, in this releasing stage, makes a small radial movement for displacing the needle hook by a few millimeters only; enough, however, to insert the receiving hook into the stitch without danger of collision with the other needle and without close tolerance requirements. The radial motions are easily accommodated by displacement, including flexure, or bending, of the needles, with the needles by nature being small springs and the stress imposed on them being permissible for unlimited repetitions and for unlimited periods of time in view of the characteristics normally imparted to the steel of which the needles are usually made.

The conceptual and kinematic simplification of the motions, the elimination of the requirement for precision, and the much shorter motions resulting from the present invention allow corresponding simplifications and lightenings in the manufacture of double cylinder knitting machines. Thereby, the cost of producing the machines should be considerably reduced, and their production efficiency and productivity increased. The present invention, by its very nature and the varied construction details of the knitting machines to which it may be applied, lends itself to other embodiment than the particular preferred embodiment disclosed here in full detail and illustrated in the drawings for disclosure purposes only; and this preferred embodiment is not intended to limit the scope of the present invention, which is to be determined only by the scope of the appended claims.

I claim:

1. In a double cylinder knitting machine of the type operable for selectively knitting plain and purl stitches, the improvement comprising single-hook knitting needles disposed on both cylinders for axial reciprocation in a knitting operation the needles in one cylinder being aligned with the needles in the other cylinder to form pairs, and means extending through the walls of each said cylinder and acting on said needles for displacing needles radially outwardly from their cylinders to allow positioning of the hooks of the other needles of the needle pairs radially inwardly of the hooks of the displaced needles for entry into knit loops initially carried on the displaced needles and for receipt of said loops on said other needles upon shedding of said loops from the displaced needles to effect transfer of said loops.

2. In a double cylinder knitting machine the improvement according to claim 1 characterized further in that said means acts to incline said needles to position the hooks thereof radially outwardly from their cylinder.

3. In a double cylinder knitting machine the improvement according to claim 2 characterized further in that said means bends said needles in displacing them to said inclined outward positions.

4. In a double cylinder knitting machine the improvement according to claim 1 characterized further in that said means includes elements carried by said cylinders for displacing engagement with said needles.

5. In a double cylinder knitting machine the improvement according to claim 4 and characterized further by cams engagable with said elements to operate said elements for needle displacement.

6. In a double cylinder knitting machine the improvement according to claim 5 and characterized further in that said elements are in the form of pins extending radially through the walls of said cylinders and said cams are positioned interiorly of said cylinder walls for engagement with inner ends of said pins.

7. In a double cylinder knitting machine the improvement according to claim 6 characterized further in that said cams comprise a stationary ring cam mounted interiorly of each cylinder in engaging alignment with said pins carried in said cylinders.

8. A method for transferring knit loops between opposing single hook knitting needles of cylinders of a double cylinder knitting machine comprising:

(a) forming knitting loops of fabric on the needles carried by the cylinders;

(b) radially engaging said needles through the walls of said cylinders and displacing needles having loops thereon on one cylinder radially outwardly from said cylinder;

(c) relatively sliding opposing needles to position the hooks of the needles carried by the other of said cylinders radially inwardly of the hooks of said displaced needles for entry of the hooks of the needles carried by the other cylinder into the loops carried by said displaced needles; and (d) shedding the knit loops from said displaced needles onto said needles of the other cylinder.

9. A method for transferring knit loops on a double cylinder knitting machine according to claim 8 characterized further in that said displacing needles inclines the needles being displaced to position the hooks thereof radially outwardly from said cylinder.

10. A method for transferring knit loops on a double cylinder knitting machine according to claim 9 characterized further in that said displacing needles bends said needles being displaced toward said inclined outward position.

* * * * *